United States Patent [19]

Beretta

[11] 4,243,198

[45] Jan. 6, 1981

[54] CONCRETE MOLDING APPARATUS

[75] Inventor: Angelo V. Beretta, Lincoln, R.I.

[73] Assignee: Durastone Co., Lincoln, R.I.

[21] Appl. No.: 891,128

[22] Filed: Mar. 27, 1978

[51] Int. Cl.[3] ..... B28B 7/12

[52] U.S. Cl. ..... 249/66 R; 249/161; 264/336; 425/139; 425/441; 425/444

[58] Field of Search ..... 425/139, 441, 444; 264/336; 249/66 R, 161

[56] References Cited

U.S. PATENT DOCUMENTS

| | | | |
|---|---|---|---|
| 2,663,063 | 12/1953 | Van Loon | 264/334 |
| 3,577,509 | 5/1971 | Hicquet et al. | 264/336 |
| 3,824,059 | 7/1974 | Heltzel | 425/424 |
| 3,989,432 | 11/1976 | Depka | 425/139 |

*Primary Examiner*—James H. Derrington
*Attorney, Agent, or Firm*—Salter & Michaelson

[57] ABSTRACT

An improved molding machine which overcomes the tendency of concrete members molded therein to become end distorted upon initial discharge movement relative to the mold cavities in which they are formed. The front set of plates which close that end of the multi-cavity mold box proximal to the discharge end of the machine are maintained in contact with the faces of the concrete member adjacent thereto at least during the initial breakaway of the concrete members from the sides of the mold. The molded members are forced out of the mold box by a hydraulic ram acting upon a second set of end plates which act to close the rear end of the mold cavities. Once the concrete members are smoothly moving relative to the mold cavities, the front set of end plates are withdrawn to enable the members to be completely discharged from the mold. A bleed orifice is placed in the return line of the hydraulic cylinder controlling the retraction action of the front end plates so that the two sets of end plates move in unison.

1 Claim, 5 Drawing Figures

CONCRETE MOLDING APPARATUS

BACKGROUND OF THE INVENTION

This invention relates to an improved machine construction utilized in the formation of cast concrete members such as pavement curbing and the like. More specifically, the invention has specific utility with molding machines of the type disclosed in Heltzel U.S. Pat. No. 3,824,059 issued July 16, 1974. Such machine supports a plural cavity mold box through several operational stations including a cement or concrete charging station, a troweling and tamping station, and a discharge station. The mold box is thus successively moved through such stations on a supporting structure until the generally longitudinally orientated concrete members are hydraulically forced out of the mold in a zero slump partially set state for subsequent curing and use. The individual cavities of the mold are formed by a bottom member and upstanding sides. The top of the mold is open as are the ends.

In order to close the ends of the mold, sets of end plates are positioned thereat by means of hydraulic cylinders and in this way support the weight of concrete bearing thereagainst during the charging, tamping and setting operations. When the mold box is transferred to the discharge station, the front end plates are moved free of the front end of the mold cavities by the upward pivoting of a U-shaped frame to which they are mounted. Thereafter the second set of end plates in contact with the rear ends of the concrete members are hydraulically forced forward so as to eject the members from the mold. In many cases, however, due to the open top nature of the mold which results in a lesser amount of frictional contact between the mold and its member at the upper end thereof, upper portions of the freed front face of the members tend to distort or move forward prior to the time that the members are forced forwardly out of the mold by the rear hydraulic ejector. This tendency can result in distorted, i.e. forwardly canted front member faces. Inasmuch as these members are generally utilized in end-to-end abutting contact with each other, a member with an imperfect front end face results in a product that is either useless or must be used for a different and lower profit purpose. Obviously it would be desirable to prevent the above described frictional forces which take place in the mold from causing imperfect cast products.

The above prior art citation and discussion thereof constitutes applicants' Prior Art Statement and in that regard a copy of the Heltzel patent is enclosed with this application.

SUMMARY OF THE INVENTION

It is accordingly a primary object of the present invention to provide a molding machine for fabricating concrete members in which both ends and particularly the front ends of each such member are restrained from slumping or other distortion while they are discharged from the mold.

A further object of the present invention is the provision of an improved mold box construction for use in a machine for molding concrete members which prevents the formation of irregularly shaped front member faces upon the discharge of such members from the mold.

A still further object of the present invention is to modify the construction of presently available concrete member molding equipment in a simple, straightforward, low-cost manner which enables the prevention of irregularly formed front member faces upon the discharge of such members from the mold.

These and other objects of the present invention are accomplished by restraining the front faces of the members by maintaining contact between the front member faces and the front end plates at least during the initial stages of discharging the members from the molds. In this manner, the tendency for the front end faces to distort or cant forward at the top portions thereof when the member initially breaks free of the mold is prevented. Once the members are freely moving in sliding frictional contact with the molds, i.e. have commenced to be ejected from the molds, the front end plates are moved free of the member front faces in order to enable the members to be pushed entirely free of the mold by the action of the second set of end plates pushing upon the rear faces of the members.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
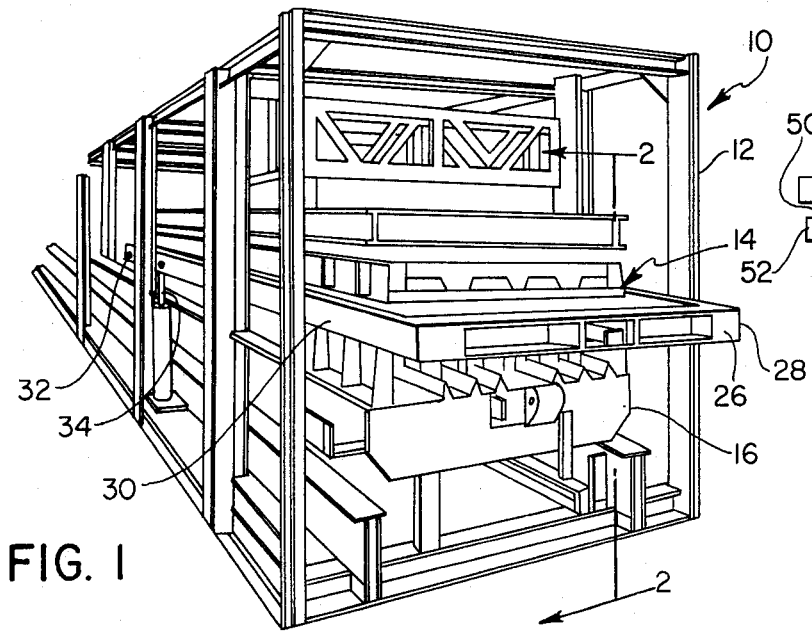
FIG. 1 is a perspective view of a machine for fabricating concrete members embodying the present invention in which the mold box assembly thereof is positioned in a discharge position.
Figure 5:
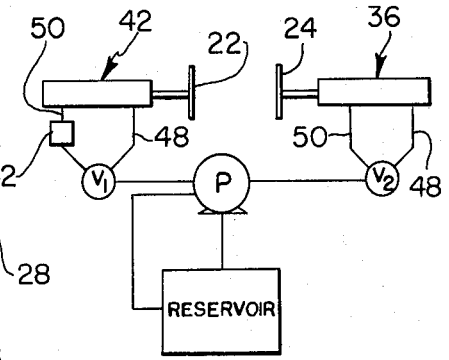
FIG. 5 is a schematic representation of the hydraulic system utilized in the present invention.
Figure 2:
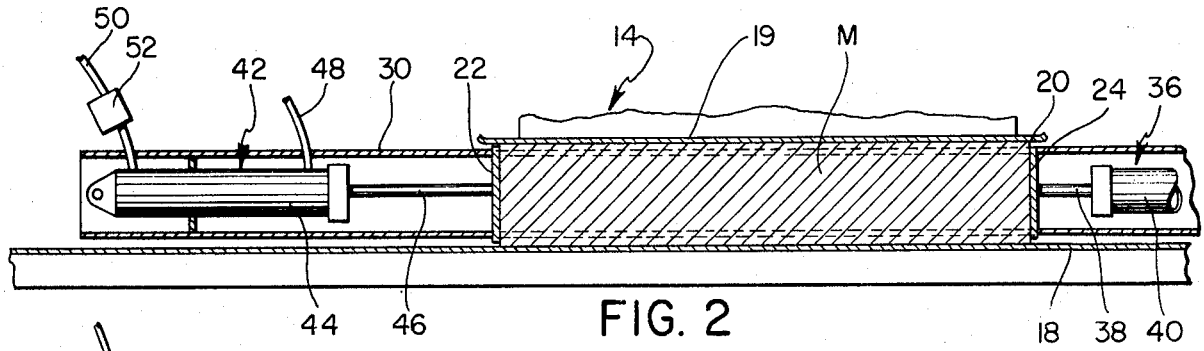
FIG. 2 is a partial side sectional view taken along the line 2—2 of FIG. 1 and shows in particular a concrete member positioned within a mold cavity prior to the initiation of its discharge therefrom.
Figure 3:
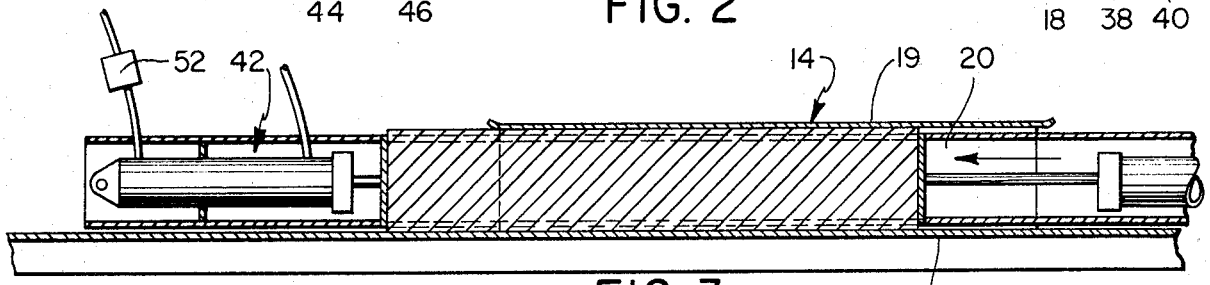
FIG. 3 is a partial side sectional view similar to FIG. 2 but showing the concrete member partially discharged from the mold.
Figure 4:
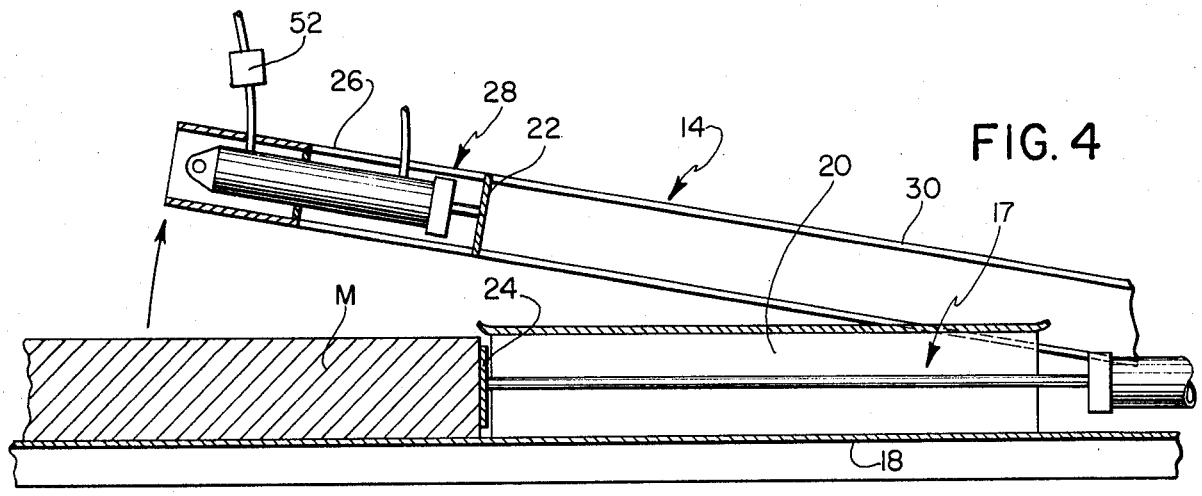
FIG. 4 is a view similar to FIGS. 2 and 3 but showing the concrete member entirely removed from the mold, the front end plates thereof having been moved free of the forward ends of the mold so as to accommodate such action.

Referring to the drawing and particularly FIG. 1, a molding machine 10 is disclosed. Except as hereinafter will be brought out, such molding machine 10 is of the construction shown in U.S. Pat. No. 3,824,059 and accordingly the disclosure of such patent is herewith included in the present specification by express reference. Specifically, the machine includes a structural frame 12 which in turn supports means (not shown) for feeding concrete or cement into a mold box 14. The mold box 14 is in turn adapted to be moved by means of a carriage frame 16 progressively lengthwise from the rear portion of the machine to the front portion thereof, whereby the mold box is sequentially moved from a cement charging station to a troweling and tamping station and then to a discharge station. FIG. 1 shows the machine 10 with the mold box 14 in such discharge position. Suitable means (not shown) but which may include an endless chain drive are utilized to move the carriage frame 16 progressively through the machine, all as fully described in U.S. Pat. No. 3,824,059.

The mold box 14 includes a plurality of open top longitudinally orientated cavities which serve to define the standard shape of curbing members M and the like. Such cavities are formed by a bottom mold plate 18 on which the cement mix is directly deposited, and spaced upstanding sidewalls 20. In order to close the open ends of such cavities 17 a first set of end plates 22 and a second set of end plates 24 are disposed at each open end thereof. The top of the cavities 17, as previously indicated, remain open so as to suitably receive the cement in the charging station and enable such to be appropriately troweled, tamped or vibrated in an intermediate station as by means of troweling plate 19.

The first set of end plates 22 are mounted on the base 26 of a U-shaped carrier member 28 having longitudinally extending legs 30 which are pivoted to the mold box 14 at points 32 at either side thereof. Accordingly, the U-shaped member 28 may be raised and lowered by cylinders 34 mounted on both sides of the machine so that the first set of end plates 22 may be moved away from the front ends of the mold cavities to permit the formed concrete members to be completely discharged therefrom.

The rear ends of the mold cavity 17 are closed by means of a second set of end plates 24 which are in turn mounted on a ram assembly 36 including a piston 38 and a cylinder 40. The end plates 24 thus simultaneously serve as pusher plates by which the formed concrete members are ejected from the cavities and the mold box 14. The first set of end plates 22 are also connected to a hydraulic assembly 42 including a cylinder 44 and a piston 46. A single pump P suitably mounted to the frame 12 is utilized to force hydraulic fluid simultaneously into each cylinder 40, 44 through entrance and exit lines 48 and 50 respectively so that the sets of end plates 20 and 24 may withstand the weight force of the concrete members during the time it is necessary for such to reach a zero slump state.

The apparatus as above described is known and described in the previously indicated Heltzel patent. When commerically used such equipment, after the members M have become suitable set up so as to assume a zero slump state, the first set of end plates 22 are normally moved away from the front end of the mold cavities 17 by the upward pivoting of the U-shaped member 28. This exposes the front surfaces or faces of the molded members M and enables them to be outwardly forced from the mold box by the ram assembly 36. As the members M first begin to exit from between the sidewalls 20 and from beneath troweling plate 19, the build-up of forces is such that the unsupported front end of the molded member M will cant forwardly or distort, whereby the front end face of the molded member will not have the true perpendicular surface necessary to enable it to be properly placed in end to end relation with another molded member, as is required when the members are abutted end to end to each other to provide an elongated curb.

In order to overcome such tendency, the return line 50 of the cylinder 44 is provided with a bleed orifice 52 and instead of immediately clearing the front end of the cavity 17 by the upward movement of the first sets of plates 22, such plates are maintained in contact with the front face of the members M at least until such members frictionally break away from the sides 20 of the mold cavities and are moving freely with regard thereto. It will thus be seen that the pump, inasmuch as such simultaneously forces hydraulic fluid to both of the cylinders 36 and 42, will control the movement of the plate and will maintain plate 22 in pressure engagement with the front end of the member M, it being understood that the plate 22 and piston 46 will be forced to retract as plate 24 and piston 38 move through their forward stroke, which retraction is permitted and controlled by the bleed orifice 52. Thus as the end plates 24 are forced through the mold cavities, the end plates 22 will be maintained against the front faces of the members so as to prevent any shape distortion thereof and by regulating the orifice 52, the speed and pressure at which such movement takes place may be controlled. Once the members M are moving smoothly with regard to the mold sides 20, the flow of hydraulic fluid to the cylinder 42 may be shut off by an appropriate valve V, and thereafter the U-shaped member 28 upwardly pivoted away from the front face of the members M and thereafter the pusher assembly 36 permitted to completely force the members out of the mold box 14. Normally the bottom of the mold cavity is formed by a mold plate 18 which forms a part of or directly rests on pallets (not shown) which ride on the ram assembly and which form the bottom of the mold box 14.

It will thus be seen by the addition of the bleed orifice 52 and by controlling the point at which the first set of end plates 22 is moved away from the front faces of the molded members, the improved results of the present invention are achieved in a straightforward, inexpensive manner which enables the substantially intact use of presently available molding equipment.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A molding machine for fabricating concrete members comprising a supporting structure having a discharge end, a mold box supported by said structure, said mold box having upstanding sides, an open top and open ends, a first end plate mounted at the discharge end of said mold box, a second end plate mounted at the other end of said mold box, discharge means for longitudinally forcing said second plate through said mold box is a first direction toward said discharge end so as to discharge a concrete member formed therein, said discharge means including means for permitting retraction of said first end plate during discharge of said concrete member while simultaneously maintaining said first end plate in pressurized contact with the discharge end of said concrete member at least during initial stages of the movement of said second plate through said mold box, so as to eliminate end distortion of the discharge end of said member as said member is forced longitudinally from between said mold sides, and means for moving said first end plate to an inoperative position out of contact with said member after predetermined movement of the latter in said first direction, said discharge means including a hydraulic pump operationally connected to both said plates for simultaneously moving said second plate in a discharge direction and maintaining said first plate in pressurized contact with the discharge end of said member, each of said plates having a hydraulic cylinder operationally associated therewith, the return line of said first end plate hydraulic cylinder having a bleed valve mounted therein for controlling the rate at which said first plate may be retracted and accordingly the rate at which said second plate may be forced through said mold.

* * * * *